US007493860B2

(12) United States Patent
Denis et al.

(10) Patent No.: US 7,493,860 B2
(45) Date of Patent: Feb. 24, 2009

(54) PROJECTILE, SUCH AS A SHELL, WHICH IS EQUIPPED WITH A BULKHEAD SHIELD

(75) Inventors: Jean-Francois Denis, Checy (FR); Bruno Charles, Beaugency (FR)

(73) Assignee: TDA Armements S.A.S. (FR)

( * ) Notice: Subject to any disclaimer, the term of this patent is extended or adjusted under 35 U.S.C. 154(b) by 0 days.

(21) Appl. No.: 11/571,266

(22) PCT Filed: Jun. 24, 2005

(86) PCT No.: PCT/EP2005/052968

§ 371 (c)(1),
(2), (4) Date: Dec. 23, 2006

(87) PCT Pub. No.: WO2006/000575

PCT Pub. Date: Jan. 5, 2006

(65) Prior Publication Data

US 2007/0227392 A1 Oct. 4, 2007

(30) Foreign Application Priority Data

Jun. 25, 2004 (FR) ..... 04 07009

(51) Int. Cl.
*F42B 10/00* (2006.01)
*F42B 25/00* (2006.01)
*F42B 12/20* (2006.01)

(52) U.S. Cl. ..... 102/473; 102/499; 102/481; 102/382; 102/396; 102/500

(58) Field of Classification Search ..... 102/227, 102/230, 275, 489, 473, 499, 481, 500, 382, 102/396

See application file for complete search history.

(56) References Cited

U.S. PATENT DOCUMENTS

| | | | | | |
|---|---|---|---|---|---|
| 1,229,506 | A | * | 6/1917 | Pail | 102/489 |
| 1,241,095 | A | * | 9/1917 | Scamohorn | 102/393 |
| 1,415,593 | A | * | 5/1922 | Lucas | 102/230 |
| 1,975,809 | A | * | 10/1934 | Teitscheid | 102/275 |
| 1,992,926 | A | * | 2/1935 | Towner | 102/251 |
| 2,889,778 | A | * | 6/1959 | Bennett | 102/245 |

(Continued)

FOREIGN PATENT DOCUMENTS

DE 36 39 319 C1 12/1987

(Continued)

*Primary Examiner*—James S Bergin
*Assistant Examiner*—Daniel J Troy
(74) *Attorney, Agent, or Firm*—Lowe Hauptman Ham & Berner, LLP

(57) ABSTRACT

The present invention relates to a bulkhead shield particularly of a projectile with a pyrotechnic charge, situated between the pyrotechnic portion and the command and control portion. The bulkhead shield comprises at least: one wall pierced by a duct; an end-cap consisting of a support portion and a portion engaged in the duct leaving a space between itself and the wall of the duct, the two portions being connected by a mechanical weakness zone; the support portion pressing on the wall, at the front, so that the engaged portion separates from the support portion under the effect of an external pressure to come into contact with the inner wall of the duct and close the space. The invention applies in particular to shells whose detonation is programmed a given delay after impact on the target.

15 Claims, 3 Drawing Sheets

U.S. PATENT DOCUMENTS

| | | | | | |
|---|---|---|---|---|---|
| 3,204,559 | A | * | 9/1965 | De Matthew | 102/202 |
| 3,726,228 | A | * | 4/1973 | Lohninger et al. | 102/275 |
| 3,786,754 | A | * | 1/1974 | Donahue et al. | 102/238 |
| 3,937,145 | A | * | 2/1976 | Lohninger | 102/275 |
| 3,952,663 | A | * | 4/1976 | Forst et al. | 102/275 |
| 3,977,330 | A | * | 8/1976 | Held | 102/210 |
| 4,242,964 | A | * | 1/1981 | Warren et al. | 102/275 |
| 4,676,163 | A | * | 6/1987 | Bell | 102/204 |
| 4,809,613 | A | * | 3/1989 | von Entress-Fursteneck et al. | 102/473 |
| 4,890,556 | A | * | 1/1990 | Ottmann et al. | 102/499 |
| H1603 | H | * | 11/1996 | Deckard et al. | 102/336 |
| 6,082,265 | A | * | 7/2000 | Sakamoto et al. | 102/206 |
| 6,640,719 | B1 | * | 11/2003 | Pacella et al. | 102/277.1 |
| 7,150,409 | B2 | * | 12/2006 | Gonnelli et al. | 239/1 |

FOREIGN PATENT DOCUMENTS

| | | | |
|---|---|---|---|
| EP | 0 426 627 | A | 5/1991 |
| FR | 2 819 885 | A | 7/2002 |
| GB | 2 006 397 | A | 5/1979 |
| GB | 2 117 492 | A | 10/1983 |

* cited by examiner

PROJECTILE, SUCH AS A SHELL, WHICH IS EQUIPPED WITH A BULKHEAD SHIELD

CROSS-REFERENCE TO RELATED APPLICATIONS

The present application is based on International Application No. PCT/EP2005/052968 filed on Jun. 24, 2005 which in turn corresponds to France Application No. 04 07009 filed on Jun. 25, 2004 and priority is hereby claimed under 35 USC §119 based on these applications. Each of these applications are hereby incorporated by reference in their entirety into the present application.

BACKGROUND OF THE INVENTION

1. Field of the Invention

The present invention relates to a projectile fitted with a bulkhead shield particularly of a projectile with a pyrotechnic charge, situated between the pyrotechnic portion and the command and control portion. It applies in particular to shells or rockets whose detonation is programmed a given delay after impact on the target.

To destroy or traverse a concrete wall for example with the aid of a shell, it is preferable to delay the detonation of the shell after the impact of the latter on the wall. The same applies when the shell must penetrate hard or soft ground or else a metal structure for example. According to a simple approach, the shell or the rocket comprises at least two portions, a command and control portion situated at the front, followed by a portion comprising the pyrotechnic charge. The command and control portion comprises in particular proximity sensors which determine the distance to the target and a command unit which activates the pyrotechnic charge especially according to the distance from the shell to the target. The charge is fired by an electric signal originating from the command and control portion of the shell. Time delay circuits may be situated in the pyrotechnic portion in particular to delay the initiation of firing of the charge following the activation signal supplied by the command portion. This delay is, for example, from a few thousandths to a few tens of thousandths of a seconds. An electric wire, more usually a flex or a bundle of wires, must therefore pass from the command and control portion to the pyrotechnic portion to allow the command signals to travel, for example, to initiate the firing. These two portions are in particular separated by a wall comprising a bulkhead shield. When the shell impacts a target, the pyrotechnic portion and particularly its firing system must not in fact be destroyed by the shatter debris caused by the impact of the shell head, in particular its command and control portion, on the target, for example a concrete wall. The bulkhead shield is placed at what is called the eye of the shell.

The aforementioned flex or bundle of wires to pass through the wall separating the two portions must in fact pass through the bulkhead shield. A hole is therefore necessary to allow the wire to pass through. In the absence of precaution, under the pressure of the impact, the various materials forming the target shatter and pack into the hole. This debris then damages the mechanisms and the electronic modules situated beneath the bulkhead shield, in the pyrotechnic portion in particular. Solutions are known for preventing shatter materials from traveling into the hole. In particular, chicanes are made to retard, or even stop, the passage of these materials. Another solution consists in producing small slots allowing the wires to just pass through. However, such solutions are complex to apply. Specifically, the thickness of the bulkhead may be for example of the order of 10 to 20 millimeters. Producing chicanes or thin slots in such thicknesses is complicated. The result thereof in particular is an added cost of producing the parts.

SUMMARY OF THE INVENTION

An object of the invention is particularly to alleviate the aforementioned disadvantages. Accordingly, the subject of the invention is a projectile comprising a front portion for command and control, a rear portion for containing a detonator and pyrotechnic charge, an electrical connection between the front portion and the rear portion for passing signals from an electronic circuit in the front portion to a detonator in the rear position, and a bulkhead shield dividing the front and rear portion; the bulkhead shield comprising a wall having a front surface facing the front portion and a duct through the wall between the front and rear portions and through which electrical connector extends, and an end cap having a closure portion shaped to close the duct and a support portion connected to the closure portion through a weakness zone which is substantially weaker than the remainder of the end cap, the support portion abutting the front surface of the wall and the closure portion being positioned over the front of the duct, the end cap and the duct being separated by a passage through which the electrical connection passes, the arrangement being such that rearward pressure on the end cap shears the weakness zone to detach the closure portion and pushes the closure portion rearward into the duct to close the duct to protect the rear portion from debris.

In one embodiment, the duct comprises at least one cylindrical portion and one conical portion, the conical portion being oriented toward the front. The engaged portion of the end-cap is, for example, cone-shaped. Advantageously, the conical portion of the duct and the conical portion of the end-cap have substantially the same angle. In another possible embodiment, the duct comprises a first cylindrical portion and a second cylindrical portion of larger cross section, the cylindrical portion of larger cross section being oriented toward the front. The engaged portion of the end-cap is, for example, of cylindrical shape with a larger cross section than the cross section of the first cylindrical portion of the duct in order to close the latter when the end-cap comes into contact with it. The duct and the end-cap are, for example, axi-symmetric. The mechanical weakness zone is, for example, a thinner zone of the support portion.

One portion comprises, for example, a pyrotechnic charge and the other portion placed at the front of the projectile comprises, for example, a command and control system, the front of the bulkhead shield being oriented toward this command and control portion.

The main advantages of the invention are that it makes it possible to produce robust bulkhead shield parts, that it enhances the reliability of a projectile fitted with such a bulkhead shield and that it is simple to apply.

Still other advantages of embodiments according to the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

Other features and advantages of the invention will appear with the aid of the following description given with reference to the appended drawings which represent.

DETAILED DESCRIPTION OF THE DRAWINGS

Figures 1A, 1B:
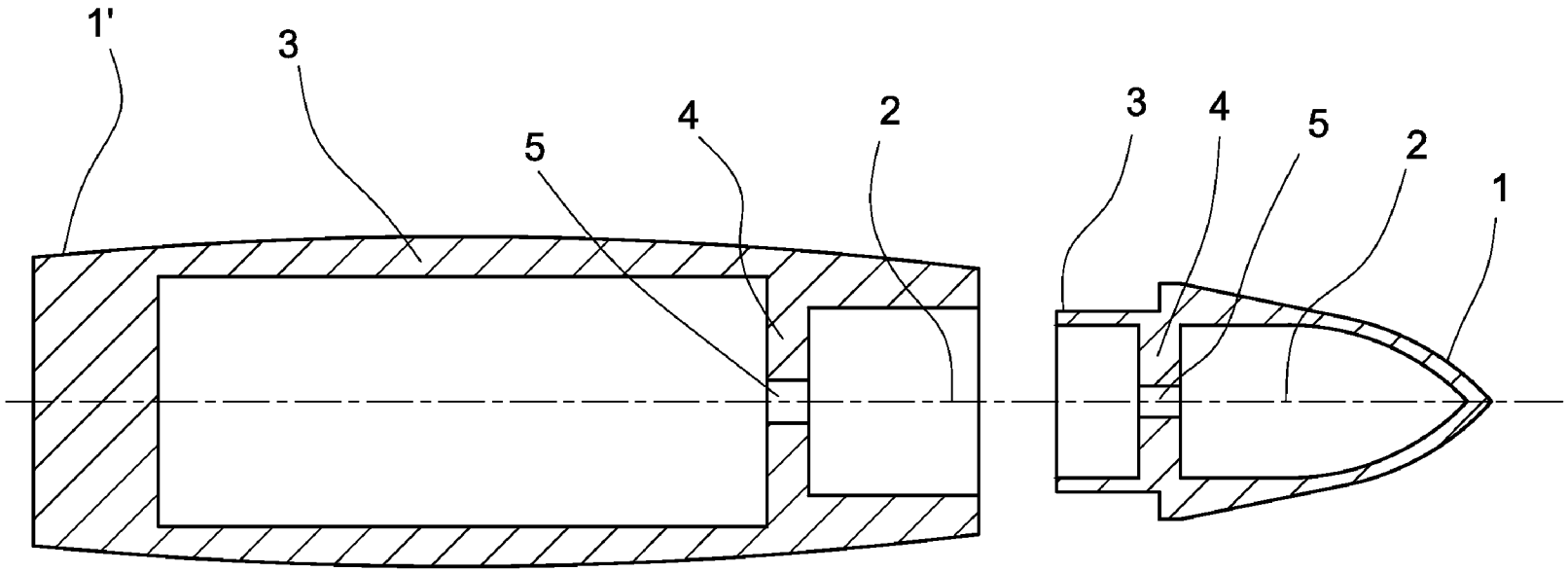
FIG. 1*a*, the situation of a bulkhead shield in a projectile, for example a shell.
FIG. 1*b*, the situation of a bulkhead shield in another type of projectile, for example, a rocket.

FIG. 1*a* shows, via a simple diagram, the situation of a bulkhead shield in a shell 1. The shell comprises at least two portions 2, 3. A first portion 2, situated at the front of the shell, comprises for example the command and control system of the shell. The second portion 3 comprises in particular its pyrotechnic charge. A wall 4 separates for example the two portions. The wall 4 is itself closed by the bulkhead shield 5 situated substantially in its center, at what is usually agreed to be called the eye of the shell. The wires carrying the control signals pass through the bulkhead shield 5. When the shell impacts a target, the shatter materials must not pass through the hole of the bulkhead shield designed for the wires to pass through, mainly to protect the firing mechanisms and the electronic modules situated in the first portion 2. These electronic modules are, for example, programmed to create a firing delay in response to an activation signal originating from the command and control portion 1. This delay is, for example, defined so that the shell detonates, for example, after having penetrated a portion of the target. This target may be, in particular, a concrete wall, hard or soft ground or else a metal structure. Hereinafter the bulkhead shield 5 will be called the shield.

FIG. 1*b* illustrates the position of a shield in a rocket. The rocket 1' also comprises two portions 2, 3. The first portion 2, situated at the front of the rocket, comprises, for example, the command and control system of the rocket. The second portion 3 comprises in particular its pyrotechnic charge. A wall 4 separates the two portions. The wall 4 is closed by the shield 5 situated substantially in its center. The wires carrying the command signals pass through the bulkhead shield 5. For the rest of the description, reference will be made to a shell as the type of projectile, however, the shield described may be used for a rocket or for other types of projectiles.

Figure 2:
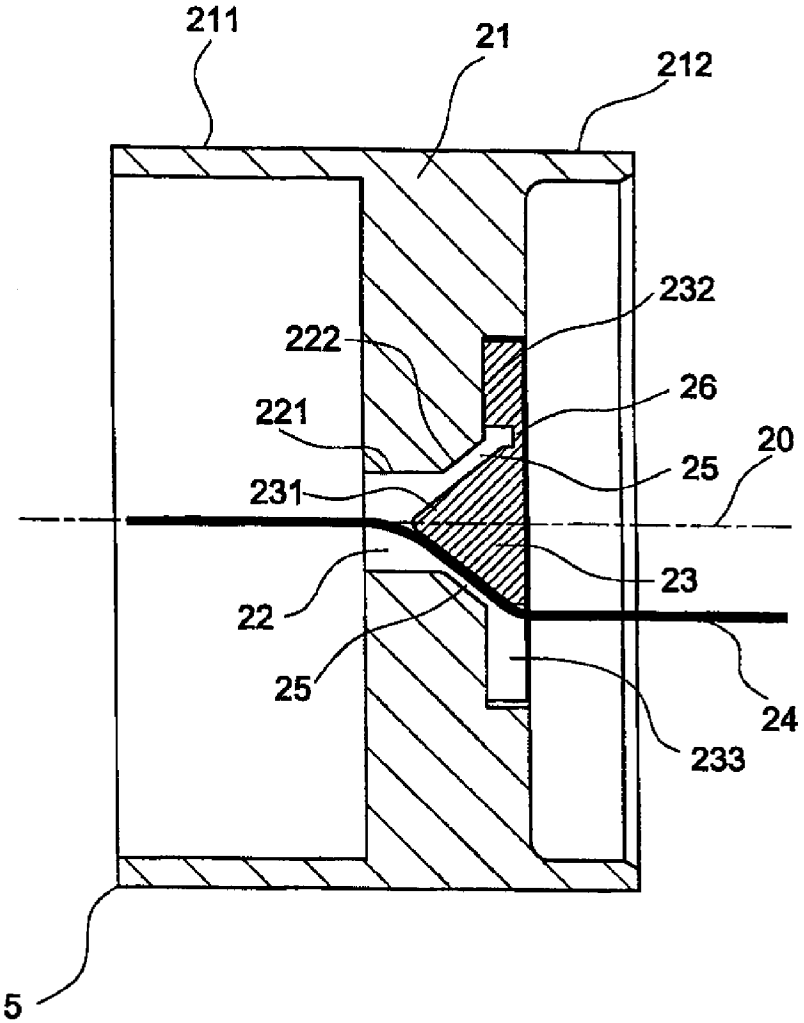
FIG. 2, a first possible embodiment of a bulkhead shield according to the invention.

FIG. 2 illustrates, via a view in section, a possible exemplary embodiment of a shield according to the invention. The shield 5 being, for example, axi-symmetric, the section of FIG. 2 passes through the axis of symmetry 20 of the shield. The shield 5 comprises a bulkhead 21, sufficiently thick to withstand the pressures generated when the shell impacts a target. The wall 21, for example, made of metal, is pierced by a duct 22 in which an end-cap 23 is engaged. The duct 22 is situated in the center of the wall 21. The duct consists of a cylindrical portion 221 and a conical portion 222. In an operating situation, when the shield 5 is, for example, placed in a shell 1, the cylindrical portion 221 of the duct is oriented toward the pyrotechnic charge, the conical portion 222 being in line with the command and control system, that is to say oriented toward the front of the shell. Preferably the end-cap 23 comprises a conical portion 231 in line with the conical portion 222 of the duct. A space is maintained between the wall of the duct and the end-cap 23 so as to allow a passageway 25 for an electric wire 24, a bundle of wires, a braid of wires or else a flex. More generally, this space is designed to allow the passage of connections 24 necessary for the transmission of signals, between the front of the shield, oriented for example toward the command and control system of a shell, and the rear of the shield, oriented for example toward the pyrotechnic charge of a shell.

In addition to its conical portion 231, the end-cap 23 comprises for example a plate 232 mechanically attached to this conical portion. The plate 232 rests for example on the wall 21 of the shield. As a result, a recess closely fitting the shape of the plate is for example made in the wall 21 in which the plate 232 is placed, the conical portion 231 of the end-cap being engaged in the duct 22. The plate 232 forms, for example, a flat cylinder so that the end-cap 23 in its entirety forms an axi-symmetric component centered on the axis of symmetry 20 of the shield 5. The plate is for example force-fitted into the wall, or welded, for holding in the closed or virtually closed position, leaving just the passageway space 25. The plate comprises for example a slot 233 to allow the connections 24 to pass through. More generally, an opening 233 in the plate made in line with the opening or passageway space 25 makes it possible to obtain a complete opening. The conical portion 231 of the end-cap 23 and the plate 232 are mechanically attached so that they can in particular form a single part. However, their mechanical linkage comprises for example a weakness zone 26 so that the conical portion 231 can separate from the plate 232. This mechanical weakness zone 26 consists for example of a thinner portion of the plate. As an example, it may be formed of a thin circular zone 26, this zone connecting the plate 232 to the conical portion 231, all nevertheless forming a single part. In the event of pressure being applied to the end-cap, the conical portion may then detach itself from the plate 232 by shearing. The wall 21 is, for example, extended on each of its sides by a recessed portion 211, 212, forming for example a hollow cylinder. A thread, not shown, may be provided for example for screwing the shield onto a support, or more particularly into the eye of the shell. Depending on the thickness of this support or because of other possible mechanical or operational constraints, the extensions 211, 212 of the wall 21 of the shield may be more or less long. The plate 232 of the end-cap 23 may be replaced by any other mechanical support fixedly attached to the conical portion 231 and capable of being separated therefrom. FIG. 2 shows a shield according to the invention before impact on a target of the projectile containing it. In this state, the shield closes a passageway separating two portions of the projectile, for example the command and control portion 2 from the pyrotechnic portion 3 of a shell, while allowing a wire, a group of wires or any type of connections 24 to pass through.

Figure 3:
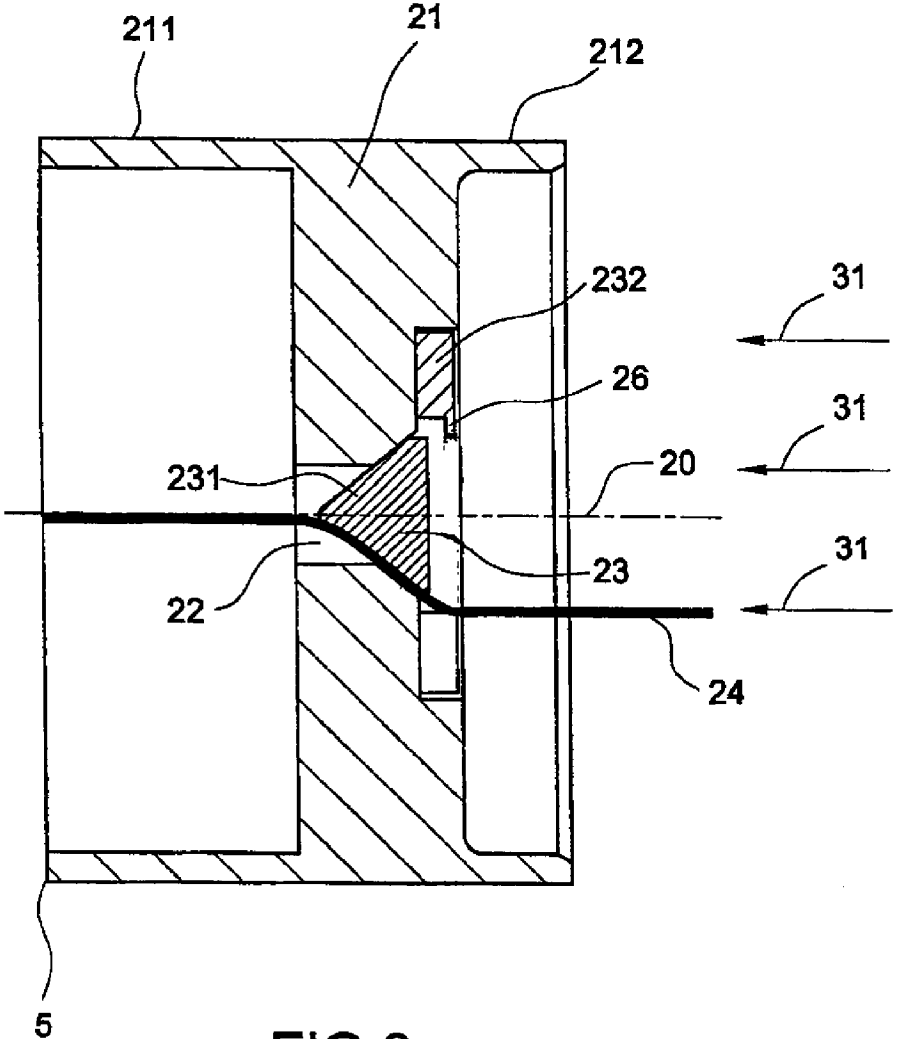
FIG. 3, the state of this bulkhead shield after impact.

FIG. 3 represents the state of the shield after impact of the projectile, or of the shell, on a target, for example on a concrete wall. Under the effect of the impact of a projectile on the target, the front of the shield and more particularly the end-cap 23 is subjected to a pressure 31 such that the conical portion 231 is separated from its support, for example the plate 232; the separation occurs at the mechanically weak zone 26 by shearing. The conical portion 231 of the end-cap is then pushed onto the flared face of the duct, in this instance its conical opening, so that the conical portion 231 comes to close the space 25 through which the connection 24 in particular passed. Preferably, the angle of the cone 231 of the shield is substantially the same as that of the opening cone of the duct 22 so as to optimize the closure. The closure of the space 25 disconnects or damages the connection 24, but that is of no importance for the rest of the operational phase. Specifically, the electric modules situated behind the shield 5 remain intact because they are protected in particular from the shatter materials due to the impact on the target. In particular, delays programmed into the electronic modules are still active. A firing delay may then be created from an activation signal transmitted by the connection 24 passing through the shield, according to the programmed instructions.

Figure 4:
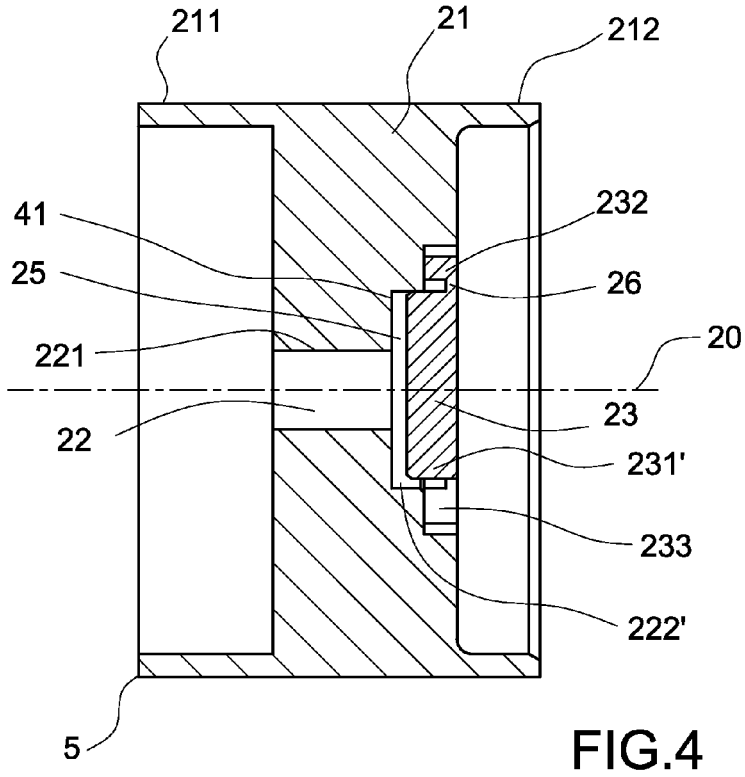
FIG. 4, another possible embodiment of a bulkhead shield according to the invention.

FIG. 4 represents another possible embodiment of a shield according to the invention. In particular, in this embodiment, the end-cap 23 and the duct 22 have shapes that differ from those of FIGS. 2 and 3. The duct 22 still comprises two portions, a first cylindrical portion 221, as in the case of FIGS. 2 and 3 is oriented toward the rear of the shield. A second portion 222', in which the end-cap 23 is engaged, comprises a wall 41 placed facing the wall of the end-cap so as to reserve a space between this wall of the duct and the wall of the end-cap. This space 25, as in the previous exemplary embodiment, is provided for a connection to pass through, this connection being able to be an electric wire or a group of wires in the form of a bundle, braid or flex. In the exemplary embodiment of FIG. 4, the portion 222' of the duct that receives the end-cap 23 forms a cylinder. The duct 22 thus comprises two cylindrical portions of different cross sections. The end-cap 23 is engaged in the cylinder with the larger cross section. The end-cap 23 still for example consists of a support 232 pressing on the wall 21 of the shield. The support 232 which may take the form of a cylindrical plate is mechanically connected to another portion 231' of the end-cap 23 by means of a mechanical weakness zone, as in the previous exemplary embodiment. This other portion 231' of the end-cap is that which is engaged in the duct 22. It has for example a cylindrical shape to fit the cylindrical wall of the duct. This portion 231' of the end-cap has a cross section at least larger than the cross section of the first cylindrical portion 221 of the duct. The support 232 of the end-cap presses on the wall 21 of the shield so that a space 25 is reserved between the end-cap and the bottom 41 of the cylinder of the duct. When the projectile impacts a target for example, the cylindrical portion 231' of the end-cap separates from the support 232 and butts against the bottom 41 of the cylinder of the duct 22. The front and rear of the shield are then firmly closed relative to one another. The support 232 of the end-cap 23 comprises, again for example, a slot 233 to allow the connection to pass through. The cylinders 231', 232 forming the end-cap are, for example, axi-symmetric. It is possible to provide embodiments in which the two cylinders are not axi-symmetric. The cylinder 222' of the duct in which the end-cap is engaged will consequently have an appropriate shape, and the cross section of the end-cap will be sufficiently large to close the first cylinder 221.

Figure 5:
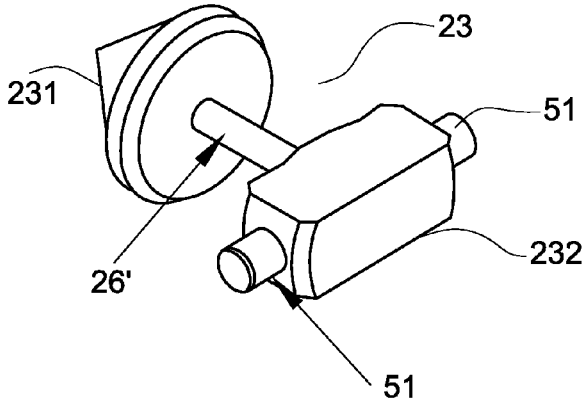
FIG. 5, another exemplary embodiment of an end-cap used in a bulkhead shield according to the invention.

FIG. 5 shows another exemplary embodiment of the end-cap 23 used in a shield according to the invention. In this example, the portion 231 of the end-cap engaged in the duct 22 has a conical shape. It is possible to provide another exemplary embodiment in which this portion has another shape, for example of the flat cylinder type as illustrated in FIG. 4. Therefore, in this exemplary embodiment of FIG. 4, the conical portion 231 is still connected to the support 232 by a mechanical weakness zone 26'. Nevertheless, in this exemplary embodiment, this zone 26' is a rod of thin cross section. The cone 231, the rod 26' and the support 232 form, for example, a single mechanical part. The support may, for example, be held pressing on the bulkhead by pins 51.

Figure 6:
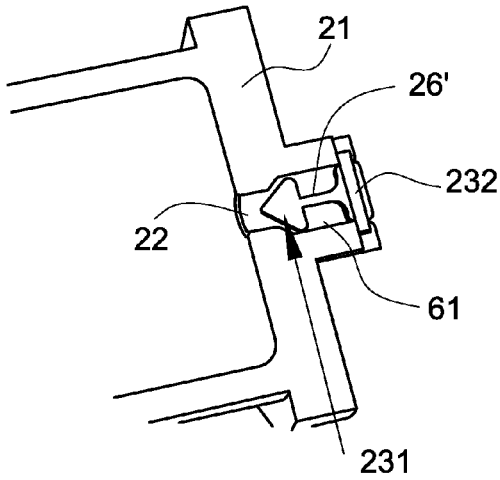
FIG. 6, the position of the abovementioned end-cap in a bulkhead shield according to the invention.

FIG. 6 shows, via a view in section and in perspective, the position of an end-cap, as illustrated by FIG. 5, in a shield according to the invention. At the duct 22, the wall 21 is, for example, extended to form a pit 61 which opens onto this duct 22. The support 232 of the end-cap 23 is then placed at the bottom of the pit, on the opposite side from the duct 22. The rod 26' traverses the pit. When the projectile impacts a target, the rod 26' breaks under the effect of the pressure applied to the conical portion 231 of the end-cap, the shatter debris passing either side of the support 232. The pressure applied to the rear of the conical portion 231 causes the rod 26' to break. The support 232 of the end-cap has a shape which does not close the pit 61, in order, on the one hand, to allow the connection or connections 24 to pass and, on the other hand, to allow the pressure to cause the rod 26' to break.

Other embodiments of a shield according to the invention are again possible so that the duct 22 of the shield comprises an inner surface substantially parallel to a surface of the end-cap 23 engaged in the duct, with a space 25 reserved between these two surfaces. Under the effect of an external pressure, the two surfaces come into contact to close the shield. The invention is cheap and simple to apply. In particular, the parts comprising a shield according to the invention may be axi-symmetric without particular reaming operations. There are at most two reaming operations to be performed. One reaming operation for the duct 22 is simple to achieve. The same applies to producing the slot 22 of the support of the end-cap designed to allow the connections to pass through. This embodiment furthermore makes it possible to obtain robust parts.

A projectile equipped at most with such a shield is therefore more reliable and also less costly to produce. As shown with reference to FIG. 1, the shield separates the pyrotechnic portion 3 of the projectile or of the shell from the command and control portion 2. A connection 24, for example an electric connection, transmits signals between the two portions.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A projectile, comprising:

a front portion for command and control;

a rear portion for containing a detonator and a pyrotechnic charge;

an electrical connection between the front portion and the rear portion for passing signals from an electronic circuit in the front portion to a detonator in the rear portion, and a bulkhead shield dividing the front and rear portions;

wherein the bulkhead shield comprises:

a wall having a front surface facing the front portion;

a duct through the wall between the front and rear portions and through which the electrical connector extends;

an end cap having a closure portion shaped to close the duct; and a support portion connected to the closure portion through a weakness zone which is substantially weaker than the remainder of the end cap, the support portion abutting the front surface of the wall and the closure portion being positioned over the front of the duct, the end cap and the duct being separated by a passage through which the electrical connection passes, the arrangement being such that rearward pressure on the end cap shears the weakness zone to detach the closure portion and pushes the closure portion rearward into the duct to close the duct to protect the rear portion from debris.

2. The projectile as claimed in claim 1, wherein the duct comprising a cylindrical rear section and a part-conical front section, which broadens towards the front portion.

3. The projectile as claimed in claim 2, wherein the closure portion is conical to fit in the part-conical front section.

4. The projectile as claimed in claim 3, wherein the part-conical front section of the duct and the closure portion have substantially the same conical half-angle.

5. The projectile as claimed in claim 1, wherein the duct comprising a cylindrical rear section and a cylindrical front section of larger cross section than the rear section.

6. The projectile as claimed in claim 5, wherein the closure portion of the end-cap is cylindrical with a larger cross section than the cross section of the cylindrical rear section of the duct, in order to close the duct when the closure portion is pushed into contact with it.

7. The projectile as claimed in claim 1, wherein the duct and the end-cap are axi-symmetric.

8. The projectile as claimed in claim 1, wherein the bulkhead shield has an axis of symmetry and the duct and the end-cap are centered on the axis of symmetry.

9. The projectile as claimed in claim 1, wherein the weakness zone is a thinned zone of the support portion.

10. The projectile as claimed in claim 1, wherein the weakness zone is a rod connecting the closure portion to the support portion.

11. The projectile as claimed in claim 10, wherein the rear portion comprises a pyrotechnic charge and the front portion comprises a command and control system connected to the electrical connection.

12. The projectile as claimed in claim 1, wherein it is a rocket.

13. The projectile as claimed in claim 1, wherein it is a shell.

14. The projectile as claimed in claim 13, wherein the bulkhead shield is placed at the eye of the shell.

15. The projectile as claimed in claim 10, wherein the detonator is connected to the electrical connection.

* * * * *